United States Patent [19]

Herr

[11] 4,352,719

[45] Oct. 5, 1982

[54] METHOD FOR PRODUCING COMBUSTION RESISTANT FIBROUS PRODUCTS

[75] Inventor: Alfons K. Herr, Stutensee, Fed. Rep. of Germany

[73] Assignee: Kataflox Patentverwaltungsgesellschaft mbH, Karlsruhe, Fed. Rep. of Germany

[21] Appl. No.: 230,506

[22] Filed: Feb. 2, 1981

[30] Foreign Application Priority Data

Jan. 31, 1980 [DE] Fed. Rep. of Germany ..... 3003371
May 24, 1980 [DE] Fed. Rep. of Germany ..... 3020033

[51] Int. Cl.[3] ..... D21H 5/00

[52] U.S. Cl. ..... 162/128; 162/159; 162/185; 162/186; 162/181.1; 162/181.3; 162/181.4; 162/181.8; 162/190

[58] Field of Search ..... 162/128, 159, 185, 190, 162/181.3, 181.4, 181.1, 181.8, 186; 106/18.13; 428/921

[56] References Cited

U.S. PATENT DOCUMENTS

| | | | |
|---|---|---|---|
| 2,935,471 | 5/1960 | Aarons et al. . | |
| 3,202,570 | 8/1965 | Videen | 162/159 |
| 3,379,608 | 4/1968 | Roberts et al. | 162/145 |
| 3,380,842 | 4/1968 | Watson . | |
| 3,438,847 | 4/1969 | Chase | 162/159 |
| 3,453,160 | 7/1969 | Darling et al. | 156/32 |
| 3,983,040 | 9/1976 | Draganov | 252/8.1 |
| 3,988,199 | 10/1976 | Hillmer et al. | 162/175 |
| 4,168,175 | 9/1979 | Shutt | 106/15.05 |
| 4,173,666 | 11/1979 | Quinto | 428/921 |
| 4,285,842 | 8/1981 | Herr | 428/921 |

FOREIGN PATENT DOCUMENTS

| | | |
|---|---|---|
| 354544 | 6/1922 | Fed. Rep. of Germany . |
| 947777 | 1/1956 | Fed. Rep. of Germany . |
| 1243574 | 6/1967 | Fed. Rep. of Germany . |
| 1812825 | 2/1974 | Fed. Rep. of Germany . |
| 2831616 | 1/1980 | Fed. Rep. of Germany . |
| 354321 | 6/1961 | Switzerland . |
| 1025188 | 4/1966 | United Kingdom . |
| 1261134 | 1/1972 | United Kingdom . |
| 1411801 | 10/1975 | United Kingdom . |
| 1555891 | 11/1979 | United Kingdom . |
| 2026500 | 2/1980 | United Kingdom . |

OTHER PUBLICATIONS

Ullmanns Encyklopädie der Technischen Chemie Bandiz, pp. 688, 715, 716, 1976.

*Primary Examiner*—William F. Smith
*Attorney, Agent, or Firm*—Spencer & Kaye

[57] ABSTRACT

A method for producing fire retardant or non-combustible fibrous products. Fibrous organic or inorganic materials, or a mixture thereof, are processed into a slurry, which is then intimately mixed with a boron-containing mineral and a mineral acid. The mixture is allowed to ripen, and is fed into a sheet forming and dewatering apparatus to form a dewatered, fibrous web, which is dried to form the fibrous product.

17 Claims, No Drawings

METHOD FOR PRODUCING COMBUSTION RESISTANT FIBROUS PRODUCTS

BACKGROUND OF THE INVENTION

The present invention relates to the field of fire retardant or fireproof products, particularly sheet or board shaped products, based on fibrous organic or inorganic materials.

The ever increasing demands for fire protection for materials of all types make it necessary to make all fibrous materials, even organic materials, fireproof or fire resistant, or to prepare them in such a way that they do not contribute to the initiation or continuation and support of a fire. The manufacture of materials of organic fiber substances however, is only possible in an economical manner if a wet process is used, i.e. in very dilute aqueous suspensions. However, the use of such dilute suspensions is not a satisfactory method for the introduction of fire protection agents which are soluble in water or could be washed away with the waste water.

German Patent Application No. P 28 31 616.7 which corresponds to U.S. Patent Application Ser. No. 057,266, discloses a method for producing a noncombustible material made of mineral substances in which residual waste water clarification sludges and/or moist wood chips are used to form a solid body. In this process, boron minerals are added to the basic structural materials and these boron minerals are mixed with sulfuric acid. The resulting mixture is then bonded together with a synthetic resin and hot pressed. The material produced in this way has properties similar to wood chip board, but, due to the proportion of boric acid as well as some glass or ceramic forming minerals which it contains, it is non-combustible. This known material is also similar to wood chip board in its manner of manufacture which, except for the incorporation of the fire protection agent, is identical to the manufacture of wood chip board. The starting materials should therefore be practically dry or have a moisture content of at most 25%.

SUMMARY OF THE INVENTION

It is an object of the present invention to introduce fire retarding agents, particularly boric acid, into fibrous products which are formed by the proven and economical wet process.

To achieve this object, and other objects, and in accordance with its purpose, the present invention provides a method for producing a fire retardant or fireproof fibrous product in which fibrous organic materials, fibrous inorganic materials, or a mixture thereof, are processed into an aqueous slurry. Boron-containing minerals and a mineral acid are intimately mixed with this slurry, and the mixture is allowed to ripen. The mixture is then fed into a sheet forming and fiber dewatering apparatus, in which a fibrous web is formed, and dewatered. Subsequently, the dewatered web is dried to form the fibrous product.

It is understood that both the foregoing general description and the following detailed description are exemplary, but are not restrictive of the invention.

DESCRIPTION OF THE PREFERRED EMBODIMENTS

The present invention seeks to utilize the method for introduction of fire retardant agents disclosed in U.S.

Application Ser. No. 057,266, in which boron-containing minerals are converted to boric acid in situ, with the use of mineral acid. This method provided good fire protection and was quite economical. While it was possible to this prior process to introduce powdered, water-insoluble fire retarding agents into dry mixtures, this dry introduction is not possible in the manufacture of the present products, such as paper board, cardboard and fiber board.

A further advantage of this prior process was in the production of a material with calcium sulfate-gypsum-adhering to the fibers or chips.

Advantageously, it is possible, according to the present invention, to combine the wet process for producing paper, paperboard, cardboard and fiber board with the prior method for the dry manufacture of fireproof materials disclosed in U.S. Application Ser. No. 057,266, to produce fiber reinforced gypsum boards which exhibit good strength characteristics with a low swelling rate and low water absorption. Such gypsum boards are utilized in particular for dry interior structures and for wall coverings, since these boards have good properties which improve the interior climate, can easily be attached by nails through the fiber reinforcement, have sufficient strength for great utility, are easy to install and, if prepared according to the invention, economical to produce. Fire resistance in such materials is of great significance since such resistance is required particularly for interior walls.

According to the invention it is possible to produce fire retardant or noncombustible products based on fibrous materials in an economical manner by processing fibrous materials into an aqueous slurry, intimately mixing a boron mineral and a mineral acid with this slurry and, after a period of ripening, feeding the mixture into a sheet forming and fiber dewatering machine to form sheets which are dewatered and then dried.

While utilizing the proven wet process, the fibrous starting materials are thus mixed with minerals which have a combustion inhibiting effect and also with boric acid which is known to have very good fire protection properties. These fire protection materials do not interfere with the proven manufacturing process which can be carried out on existing machine lines without further investment. However, the present process is also highly advantageous in that the final products are not only fire resistant but also when economical calcium containing boron minerals and sulfuric acid are utilized, these components react to produce calcium sulfate-gypsum-which imparts to the product very high strength. This is thought to be due to the fact that the calcium sulfate supports the bond between the individual fibers and extraordinarily strengthens the fiber web. In this way it is possible not only to produce fire retardant products but also reinforced gypsum boards. If the amount of calcium sulfate which results from the reaction is not sufficient for the desired characteristics of the resulting fiber material when formed into a gypsum board, calcium sulfate, for instance, as prepared gypsum can be added directly to the fiber slurry. The present invention provides a completely novel fibrous material which is of extraordinary significance particularly for the interiors of rooms since it provides both protection against fire and significantly improved strength characteristics compared to the prior art gypsum boards.

The properties of the boards produced according to the present invention can be varied by the addition of various minerals, which should be noncombustible. For this purpose, expanded minerals, such as expanded clay, expanded slate, perlite and vermiculite have been found particularly advantageous. These expanded minerals are noncombustible, but contribute significantly to heat retention and nailability of the products produced therefrom.

Organic fibers which can be obtained economically, including those obtained as waste products, can be used to produce the fibrous products of the present invention. These organic materials include defibrator material, wood fibers, sodium cellulose and various defibrated types of papers, including newsprint and soda kraft paper.

Defribrator materials are wood particles which are heated in an autoclave under high steam pressure and are defibrated via a nozzle by sudden pressure reduction.

Other fibers which may be utilized include inorganic fibers, such as asbestos and other mineral fibers, glass fibers and plastic fibers. Mixtures of various types of organic and inorganic fibers may also be utilized.

A fibrous slurry is prepared from the fibrous materials discussed in an apparatus such as a hollander beater or other beaters commonly used in papermaking. The solids content of the aqueous fiber suspension formed will depend on the requirements of the dewatering machine to be utilized in the process, but will usually be about 0.5% to about 5%.

To the slurry is added a boron-containing mineral. Calcium containing boron minerals such as colemanite, pandermite, and ulexite are prefered, but it is also possible to use other minerals. Mixtures of minerals may be used. Especially preferred is colemanite with a boron content of about 45%, expressed as $B_2O_3$.

In order to obtain a neutral, nonreactive product, the mineral acid is advisably added in stoichiometric proportions to react completely with the boron mineral. It can be added in such quantities that the mixture, immediately after the addition of the mineral acid, is at a pH between 1.5 and 3.0, preferably about 2.0. Sulfuric acid, especially concentrated sulfuric acid, is preferably used as the mineral acid, since it results in the formation of calcium sulfate as previously discussed. Further, sulfuric acid is also available at low cost as a waste acid. Phosphoric acid may also be used.

After addition of the mineral acid, the mixture is generally allowed to ripen in order to increase the tendency toward neutralization of the acid. Ripening advisably takes place until the pH of the mixture rises to about 4.5 to 4.8, indicating conversion of the boron-containing mineral to boric acid. This pH is generally attained—in dependence on the composition of the material—within about 30 minutes.

After ripening, the mixture is processed in suction-filtered paper making machinery well known to the paper making art, such as Fourdrinier machines or cylinder machines. Such machinery includes a sheet forming apparatus and a dewatering apparatus. The dewatered sheet formed from the fiber mixture according to the present invention is dried into a final product by drying means standard in the papermaking art. Temperatures of less than 100° C. at the entrance to the drying apparatus are recommended, so that the web will initially be heated uniformly and water at the interior of the web can easily escape during final drying.

If it is necessary or desirable to make the starting fibrous material of the invention heavier, coarse to fine grained comminuted minerals, advisably those which vitrify or form ceramics when exposed to fire, may be added to the fiber slurry before further processing e.g., aluminum oxide (clay), silicon oxide (quartz sand).

In a preferred embodiment of the present invention, the production water which is the water removed from the paper in the dewatering step is recirculated to the slurry formation, in a continuous operation. In this way, the chemicals dissolved in the production water, particularly the portion of the fire protection agents dissolved in the water, can be returned to the slurry to further treat fibers. This production water can also be sprayed directly onto the fiber web when it is in the screen section of the Fourdrinier machine, with the possible addition of water-soluble fire protection agents to the water prior to the spraying.

It is also possible to produce two layer or multiple layer boards by a method forming a fiber-slurry with a relatively higher boron minerals/mineral acid content, which can then be poured onto a previously formed or just forming board.

Advantageously, the temperature of the fiber slurry during the steps of processing, mixing and ripening is maintained at room temperature, or at or below about 20° C. Maintaining these temperatures prevents reaction of the fire protection agents with the waste water, and their possible loss in this manner.

The present invention enables the production, from the fibrous materials, of a product with boric acid particles attached to its fibers. When calcium containing boron minerals and sulfuric acid are used, the interstices between the individual fibers are filled at least in part with gypsum. Thus, fibrous materials are produced which, depending on their mineral content maybe more in the form of fiber boards or more in the form of gypsum boards.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

For the manufacture of about 1000 kg of a difficultly flammable wood fiber insulating board, 643 kg of a defibrator material or wood fibers or a mixture of the two substances are introduced into a hollander beater of 15 $m^3$ capacity. This mixture is brought to the desired degree of comminution by subsequent grinding. Then 240 kg of the boron mineral colemanite, containing about 45% boron as $B_2O_3$ is homogeneously mixed in. Concentrated sulfuric acid is then mixed in slowly until the pH of the mixture has been brought to 2.0–2.5, and the mixture is allowed to ripen for about 10 minutes in a vat. The pH after ripening has risen to about 4.5 to 4.8. The ripened mixture is brought to further processing stations, where the fiber suspension which has been diluted to the extent necessary in the machine vat is dewatered in a normal Fourdrinier machine to form a fiber web.

The web is brought into a drying conduit, where it is dried to about 5% residual moisture. The entrance temperature in the drying conduit is kept below 100° C.

The manufacturing parameters correspond to those used in the manufacture of normal wood chip board.

EXAMPLE 2

To produce a fiber reinforced gypsum board, 225 kg wood chips or defibrator material or a mixture of the two are introduced into a hollander beater and mixed with production water obtained from dewatering of fibers during a subsequent process step described below to produce a fiber suspension containing 5% solids. Then, 480 kg colemanite, containing about 45% boron as $B_2O_3$, is added and the mixture is mixed until homogeneous. Thereafter, 235 kg of concentrated sulfuric acid is mixed in slowly, with the pH of the acidified mixture lying between 2.0 and 2.8. In the subsequent storage vat, this mixture ripens, with the pH rising to 4.5 to 4.8. The fiber mixture is then processed further in the same manner as would be a fiber insulation board. (See Example 1.)

The resultant product is a reinforced gypsum board. It is interesting to note in this connection that the boric acid content of the gypsum board, when the production water is recirculated, is about 26 percent by weight in the final product, and the product is thus noncombustible according to German Industrial Standard DIN 4102, Class A2. To further enhance, the characteristics of a gypsum board, it is possible to add to the ripened fiber slurry gypsum which has advisably been prepared with production water. The dewatering then takes place in a suitable prior art dewatering machine. In any case, the final result is a reinforced gypsum board which is not only fire resistant or noncombustible, but also exhibits significant strength characteristics.

EXAMPLE 3

For the manufacture of a fire protected hard fiber board, starting materials are used as in Example 1. Before the finished mixture of fibers, colemanite and sulfuric acid is discharged from the hollander beater or mixing vat, 0.5 to 2% of an acid hardening synthetic phenolic resin are added.

After leaving the dewatering machine, the fiber sheets are further dewatered in a press and pressed into a hard fiber board which receives its customary strength by bonding the fibers under heat and pressure and which is additionally fire resistant.

EXAMPLE 4

To produce a difficultly flammable fiber insulation board which is later to be processed into molded bodies, a fiber suspension as in Example 1 is first produced in a hollander beater or in a mixing vat and colemanite and sulfuric acid are added. After the mixture has ripened, its pH rises to about 5.0. Now at least 20 parts by weight (with reference to the total dry weight of the material employed) of precipitatable thermoplastic plastic in powder or dispersed form e.g. a redispersible PVC powder are added to the fiber slurry and are fixed on the fibers according to the customary precipitation method. It is advisable to select for this purpose a plastic which contains a softener.

The fiber slurry is processed further, as described in Example 1, into fiber insulation boards. The finished fiber insulation boards can be pressed into molded bodies under heat and pressure in a mold consisting of a die and a counter-die.

EXAMPLE 5

To produce 1000 kg of difficultly flammable packing papers, a hollander beater is filled with 321 kg absolutely dry paper from newsprint, and 321 kg absolutely dry ground and mixed sodium cellulose. After sufficient decomposition of the fibers, 240 kg colemanite containing 44% boron, finely ground, is added. The fiber slurry should have a solids content of about 5 percent by weight.

Fresh water is initially added for the fiber slurry, and later the waste water from the production of the papers in the cylinder or Fourdrinier machine, is recycled to the slurry.

The fiber and colemanite mixture is now acidified by the slow addition of 117 kg concentrated sulfuric acid until it reaches a pH of 2.0 to 2.5. The mixture is allowed to ripen for at least an hour until the pH rises to 4.5, and is then processed further in the customary manner. The final product is a strong non-flammable paper.

EXAMPLE 6

In order to produce 1000 kg of a fire retardant paper board, for example for the lining of automobile interiors, into a hollander beater is added 300 kg absolutely dry ground and mixed soda kraft paper, 200 kg absolutely dry waste paper (ground and mixed files), and 100 kg soda kraft paper.

To produce the fiber slurry, fresh water is used initially and once the process has started use is made of the water returned from the suction section of the Fourdrinier machine. The solids content of the slurry is 5%. 240 kg colemanite, containing about 45% boron as $B_2O_3$ is homogeneously mixed into the fiber slurry. As soon as the mixture of fibers and colemanite has reached the desired uniform dispersion, 117 kg concentrated sulfuric acid or the corresponding stoichiometric amount of diluted sulfuric acid, is slowly mixed into the circulating fiber slurry and mixing is continued until the mixture is homogeneous and has reached a pH of 2.0 to 2.5. The material then ripens in the storage vat, and the pH rises to 4.5 to 4.8. In the machine vat, the mixture is brought to the proper consistency for processing. The fiber slurry is processed in the customary manner. The result is a strong paper board which is not flammable.

It is understood that the above description of the present invention is suseptible to various modifications, changes and adaptions, and the same are intended to be comprehended within the meaning and range of equivalents of the appended claims.

What is claimed is:

1. Method for producing a fire retardant or fireproof fibrous product, comprising:

(a) processing fibrous organic materials, fibrous inorganic materials or a mixture thereof into an aqueous slurry;

(b) intimately mixing with said slurry at least one boron-containing mineral which reacts with a mineral acid to form boric acid and at least one mineral acid to form boric acid;

(c) allowing the slurry, mineral and acid mixture to ripen;

(d) feeding said ripened mixture into a sheet forming and dewatering means to form a dewatered fibrous web; and (e) drying said dewatered fibrous web to form said fibrous product.

2. Method as defined in claim 1, wherein said fibrous product is sheet or board shaped.

3. Method as defined in claim 1, wherein said at least one boron-containing mineral contains calcium.

4. Method as defined in claim 1, wherein said at least one mineral acid is sulfuric acid.

5. Method as defined in claim 1, 2, 3 or 4, additionally comprising mixing calcium sulfate into said aqueous slurry prior to said step of intimately mixing.

6. Method as defined in claim 1, 2, 3 or 4, wherein sufficient mineral acid is mixed with said slurry to lower the pH of said slurry, prior to said step of allowing the mixture to ripen, to 1.5 to 3.0.

7. Method as defined in claim 6, wherein the pH of said slurry is lowered to about 2.0.

8. Method as defined in claim 1, 2, 3 or 4, additionally comprising mixing at least one further ground mineral into said slurry prior to said step of intimately mixing.

9. Method as defined in claim 8, wherein said at least one mineral is an expanded granular mineral.

10. Method as defined in claim 9, wherein said expanded granular mineral is vermiculite, expanded clay, expanded slate or perlite.

11. Method as defined in claim 1, 2, 3 or 4 conducted in a continuous manner, wherein the water released when the web is dewatered is recycled to provide at least part of the water in said aqueous slurry.

12. Method as defined in claim 11, additionally comprising adding at least one fire protection agent to said water released when the web is dewatered, prior to recycling.

13. Method as defined in claim 1, 2, 3 or 4, wherein said sheet forming and dewatering means includes a screening means, and the water obtained when the web is dewatered is sprayed onto said web at said screening means.

14. Method as defined in claim 13, additionally comprising adding at least one fire protection agent to the water released when said web is dewatered prior to spraying.

15. Method as defined in claim 1, 2, 3 or 4, comprising forming said web on top of a previously formed web or a concurrently forming web, wherein the slurry which forms the said web comprises a relatively larger amount of said at least one mineral than said previously formed or forming web.

16. Method as defined in claim 1, 2, 3 or 4, wherein said steps of processing, mixing, and allowing the mixture to ripen are conducted at a temperature of no more than about 20° C.

17. Method as defined in claim 1, 2, 3 or 4, wherein the pH of the mixture rises to 4.5 to 4.8 during ripening.

* * * * *